US006498559B1

(12) United States Patent
Cornell et al.

(10) Patent No.: US 6,498,559 B1
(45) Date of Patent: Dec. 24, 2002

(54) CREEPLESS SNAP ACTING BIMETALLIC SWITCH HAVING STEP ADJACENT ITS BIMETALLIC ELEMENT

(76) Inventors: Christopher Cornell, 463 Rock O'Dundee Rd., South Darthmouth, MA (US) 02748; Frank J. Sienkiewicz, P.O. Box 507, Bristol, RI (US) 02809

( * ) Notice: Subject to any disclaimer, the term of this patent is extended or adjusted under 35 U.S.C. 154(b) by 0 days.

(21) Appl. No.: 09/577,555

(22) Filed: May 24, 2000

(51) Int. Cl.[7] ..... H01H 71/16; H01H 71/14; H01H 71/02

(52) U.S. Cl. ..... 337/53; 337/85; 337/36; 337/89; 337/365; 337/380; 29/623

(58) Field of Search ..... 337/36, 77, 324, 337/362, 388, 389, 397, 333, 342, 343, 365, 372, 375, 377, 380, 390, 391, 361, 52, 53, 85, 89, 100–102, 131, 135, 141; 29/623

(56) References Cited

U.S. PATENT DOCUMENTS

| | | | | | |
|---|---|---|---|---|---|
| 2,340,056 | A | | 1/1944 | Harrison | |
| 2,724,753 | A | | 11/1955 | Miles | |
| 3,067,306 | A | | 12/1962 | Epstein | |
| 3,305,655 | A | * | 2/1967 | Marcoux | 200/138 |
| 3,753,195 | A | * | 8/1973 | Woods | 337/347 |
| 3,996,547 | A | * | 12/1976 | Kinjo | 337/363 |
| 4,039,992 | A | | 8/1977 | Givler | |
| 4,278,960 | A | | 7/1981 | Muller | |
| 4,319,214 | A | | 3/1982 | Givler | |
| 4,424,506 | A | | 1/1984 | Burch | |
| 4,470,033 | A | * | 9/1984 | Hofsass | 337/343 |
| 4,517,541 | A | | 5/1985 | Ubukata et al. | |
| 4,563,667 | A | | 1/1986 | Hofsass | |
| 4,862,133 | A | | 8/1989 | Tabei | |
| 4,970,485 | A | * | 11/1990 | Wahls | 337/335 |
| 5,121,095 | A | | 6/1992 | Ubukata et al. | |
| 5,309,131 | A | | 5/1994 | Hofass et al. | |
| 5,428,336 | A | | 6/1995 | Smith et al. | |
| 5,555,972 | A | * | 9/1996 | Schwab | 200/451 |
| 5,574,421 | A | | 11/1996 | Hickling | |
| 5,659,285 | A | | 8/1997 | Takeda | |
| 5,685,481 | A | | 11/1997 | Murphy et al. | |
| 5,745,022 | A | * | 4/1998 | Becher et al. | 337/104 |
| 6,064,295 | A | * | 5/2000 | Becher et al. | 337/349 |
| 6,249,210 | B1 | * | 6/2001 | Hofsass | 337/324 |

FOREIGN PATENT DOCUMENTS

| | | |
|---|---|---|
| EP | 0 858 090 A2 | 8/1997 |
| EP | 0 858 090 A3 | 5/1999 |
| JP | 62-130310 | 5/1987 |

* cited by examiner

*Primary Examiner*—Anatoly Vortman
(74) *Attorney, Agent, or Firm*—Sampson & Associates

(57) ABSTRACT

A bimetallic switch comprising a bimetallic element having an outer edge and being adapted to snap between an open mode and a closed mode; a movable contact disposed on the bimetallic element; a first terminal in electrically conductively coupled to the movable contact; a fixed contact disposed adjacent the movable contact such that, when the switch is in a closed position, the fixed contact and the movable contact are in engagement with one another, and when the switch is in an open position, the fixed contact and the movable contact define an open contact gap therebetween; a second terminal electrically conductively coupled to the fixed contact; a step disposed adjacent the outer edge of the bimetallic element such that a clearance is defined therebetween when the bimetallic element is in its closed mode, the clearance being positioned and dimensioned such that, when the outer edge of the bimetallic element deforms prior to a snapping open thereof, the clearance isolates a deformation of the outer edge thereby keeping the switch closed until the snapping open of the bimetallic element.

24 Claims, 4 Drawing Sheets

DETAIL B

DETAIL A

DETAIL B

CREEPLESS SNAP ACTING BIMETALLIC SWITCH HAVING STEP ADJACENT ITS BIMETALLIC ELEMENT

FIELD OF THE INVENTION

The invention relates to a bimetallic switch having a bimetal disc as the switching element.

BACKGROUND OF THE INVENTION

Temperature controlled bimetallic switches are well known in the art. The bimetal supplies the force to open or close the contact system of the switch. These switches are used to prevent overheating or overcurrent conditions in a great number of electrical appliances, both large and small, such as household appliances, automobile components, and office automation equipment.

Various shapes of bimetallic elements are available, such as discs or cantilever strips. The thermal deflection of a strip element is usually easier to predict because formulas to predict deflection due to temperature are readily available. On the other hand, snap-acting bimetallic discs are also useful. These tend to change from a concave shape to a convex shape in response to changes in temperature.

There are three classifications to the type of bimetallic switches available in the art. These are: automatic reset, manual reset and one shot. Automatic resets have two distinct temperature points. A normally closed switch will open when exposed to heat at the higher of the two temperature points. When the switch cools, it will then automatically close at the lower temperature threshold. Manual reset switches, on the other hand, are typically closed, and have only an open threshold temperature. They require an outside force (such as, for example, a push button), to reset the bimetal disc after it has been opened. One shots will snap open only once and will not reset under normal conditions. They are actually automatic devices, except that the disc has been formed to have a low temperature point below −100° Celsius. While one shots and manuals are typically used to protect a process, automatics are used on the other hand to control a process. There is, in addition, a hybrid version of an automatic switch, which is called a power down reset. The device includes a heat source which is activated when the contacts are opened because of increased temperature. This heat source produces enough heat to keep the bimetal above the low reset temperature threshold. In order for the device to reset, power to the switch must be removed and the temperature be low enough for the device to reset.

Bimetallic discs are said to "snap" when they change state from a crown up or dome shape to a crown down or dish shape when exposed to increased temperature. The time that the disc takes to snap is related, among other things, to the temperature change that it is exposed to.

One problem associated with the use of bimetallic switches is creep. The snapping over of the disc does not occur evenly across the snap time. There is in fact a transition state where the disc moves very slowly when compared to the total action time. This slow rate of movement is called "creep". Thus, when a formed snap acting bimetallic element gets close to its snap temperature (i.e. the threshold temperature at which the bimetallic element snaps in order to open or close the switch), it begins to deflect slightly. Depending on how the contact system is arranged, this small deflection or creep may lead to a contact gap prior to a snapping over of the bimetallic element. It is to be noted that the size of the arc is additionally related to electrical load and voltage as well as to other environmental factors. As a result, some thermostats may not arc because of the loads they switch.

Among examples of bimetallic switches of the prior art which may exhibit the problem of creep are those described in U.S. Pat. Nos. 4,862,133, 4,517,541, 4,424,506, 3,577,111, 3,067,306, 2,724,753 and 2,340,056.

Various designs for bimetallic switches have been proposed to resolve the problem of creep.

Japanese Patent Number 63-292539 discloses a bimetallic switch designed to prevent malfunction and vibrations during normal service. Here, as seen in the figures of that patent, the bimetallic disc 4 is supported by support pieces 7 having supporting surfaces 6, which are formed alongside the locus of the ends 8 of disc 4 under the service temperature thereof. Even though the disc deforms within the temperature range of its service temperature, the convex side of the central part 5 of bimetal 4 does not push the base 1 or movable contact piece 3, or separate therefrom, to a great extent. In this way, malfunction due to creep, and vibrations, may be prevented.

U.S. Pat. No. 5,121,095 uses an elaborate spring member independent of the contact arms to remove creep. The switch contacts are actuated via the bimetal to a spring member, to an insulated pin, and to a contact arm system.

Other current designs remove creep through an expensive measurement and custom part assembly process which involves the installation of a pin measured to very small tolerances, such as 0.001", in each thermostat assembly. In such a case, a manufacturer must stock numerous pins to allow for the tolerance stack of the final assembly.

The above devices, which address the problem of creep, nevertheless do so at the cost of having to provide complicated and difficult to manufacture designs for bimetallic switches. Attention must be paid to the costs of manufacture including both labor and material costs.

It is therefore an object of the invention to provide a simple and cost effective bimetallic switch which allows for a creepless contact system. It is a further object to provide a bimetallic switch having a small footprint. It is a further object of the invention to provide a bimetallic switch where the disc is placed vertically, thus allowing for a relatively larger sized disc.

SUMMARY OF THE INVENTION

The above objects, and others to become apparent as the description progresses, is achieved by the provision of a bimetallic switch comprising a bimetallic element having an outer edge and being adapted to snap between a first mode and a second mode; a movable contact disposed on the bimetallic element; a first terminal in electrically conductively coupled to the movable contact; a fixed contact disposed adjacent the movable contact such that, when the switch is in a closed position, the fixed contact and the movable contact are in engagement with one another, and when the switch is in an open position, the fixed contact and the movable contact define an open contact gap therebetween; a second terminal electrically conductively coupled to the fixed contact; a step disposed adjacent the outer edge of the bimetallic element such that a clearance is defined therebetween when the bimetallic element is in its first mode, the clearance being positioned and dimensioned such that, when the outer edge of the bimetallic element deforms prior to a snapping thereof out of its first mode, the clearance isolates a deformation of the outer edge until the snapping of the bimetallic element. Advantageously, the bimetallic element is a bimetallic disc.

According to one embodiment of the invention, the switch further comprises a housing having inner walls defining an enclosure therein, wherein: the bimetallic element, the movable contact and the fixed contact are disposed within the enclosure; and the step is integral with the inner walls of the housing.

According to another embodiment, the bimetallic switch further comprises a cantilever, movable arm supporting the bimetallic element at one end thereof; and a stationary arm disposed adjacent the cantilever arm and supporting the fixed contact thereon.

Optionally, the bimetallic element is oriented such that a snapping direction thereof is perpendicular to a direction of current flow into and out of at least one of the first terminal and the second terminal. Preferably, the first terminal and the second terminal are substantially planar, and the bimetallic element is a bimetallic disc oriented such that a plane including its outer edge is orthogonal relative to a plane of the first terminal and the second terminal. According to a further embodiment, the step is configured such that, when the outer edge of the bimetallic element has deformed just prior to a snapping thereof, the outer edge rests upon an engaging surface of the step substantially without a clearance therebetween.

Preferably, the housing is parallelepiped shaped, the bimetallic switch further including a cover for closing the enclosure.

According to another embodiment, where the bimetallic switch is a disc, the step is dimensioned and shaped to extend in a plane that is substantially parallel to a plane including the outer edge of the bimetallic disc and which intersects the bimetallic disc at a point within a predetermined range of 65 to 95 percent of a radius thereof when the bimetallic disc is in its closed mode.

According to one embodiment, the first mode of the bimetallic element corresponds to a closed position of the switch, and the second mode of the bimetallic element corresponds to an open position of the switch. In such a case, the movable contact may be positioned with respect to the fixed contact for maintaining a minimum open contact gap therebetween thereby isolating creep during contact closure. Alternatively, the first mode may correspond to an open position of the switch, and the second mode to a closed position of the switch.

DETAILED DESCRIPTION OF THE INVENTION

Figure 1:
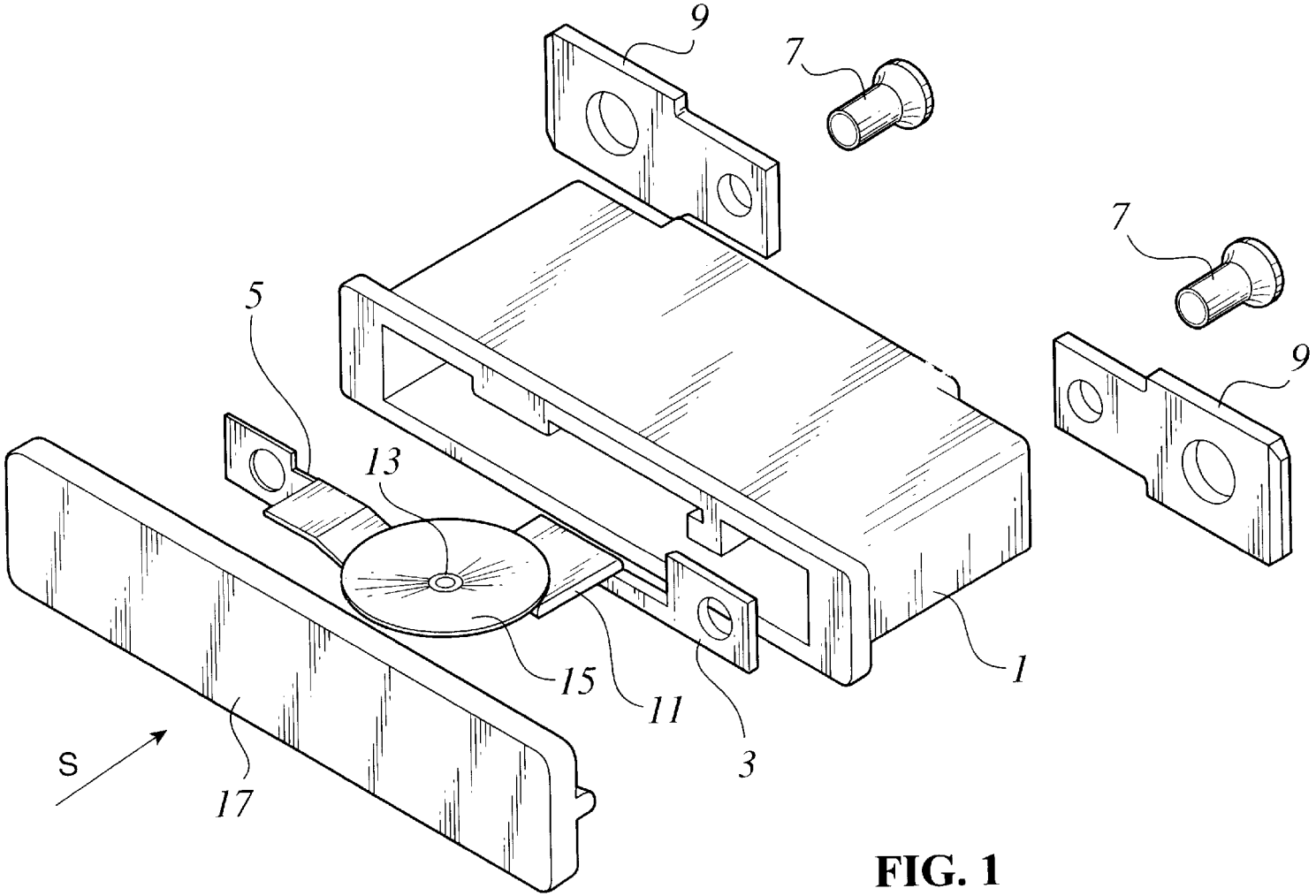
FIG. 1 is an exploded, perspective top view of an embodiment of a bimetallic switch according to the invention.
Figure 2:
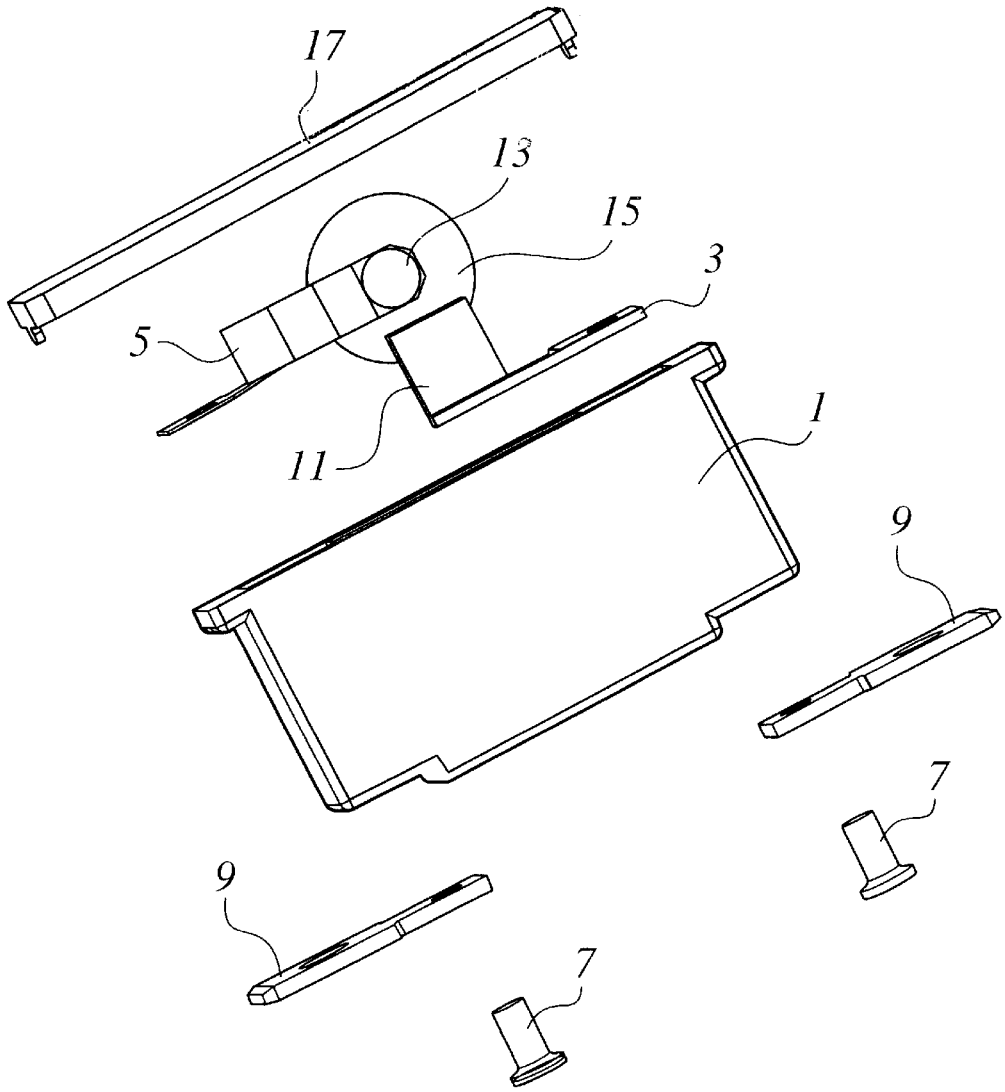
FIG. 2 is an exploded perspective bottom view of the bimetallic switch of FIG. 1.

Referring to the drawings, as seen in FIGS. 1 and 2, an exemplary embodiment of a bimetallic switch according to the invention includes a housing or base 1 made of an electrically non-conductive material, for example of steatite or alumina, which houses therein a stationary arm 3 and a movable arm 5 secured to housing 1 by way of rivets 7 which additionally secure substantially planar terminals 9 to arms 3 and 5. Rivets 7 are preferably made of steel. Arms 3 and 5 and terminals 9 are also, as would be well recognized by a person skilled in the art, made of an electrically conductive material. Stationary arm 3 includes thereon a fixed contact 11, which interacts with a movable counter-contact 13 disposed on a bimetallic disc 15 affixed to the movable arm 5. The contacts 11 and 13 may be made of a silver alloy on a copper alloy base, and the bimetallic element is made of a bimetal material dictated by temperature. A cover or lid plate 17 made, for example, from steel, aluminum or brass, is provided for enclosing the movable arm, stationary arm and contacts within housing 1, the cover being secured to the housing via conventional means, such as, for example, a snap-fit mechanism as shown in the figures. Movable arm 5 is supported in a cantilever manner above stationary arm 3 for supporting the bimetallic disc 15 and contact 13 thereon. The stationary arm and the movable arm are preferably made of a copper alloy. The stationary arm may be about 0.024" thick, and the movable arm about 0.006" thick. Contacts 11 and 13 may be made, by way of example, from brass with optional plating, and may be about 0.020" thick, as is well known in the art. The switch is preferably rated (i.e., by the National Electrical Manufacturer's Association (NEMA)) for 120/240 Volts AC, 15 Amps (at 120 Volts), 10 Amps (at 240 Volts), with a temperature range of 32 to 450 degrees Fahrenheit (depending on the bimetallic element selected).

Figure 3A:
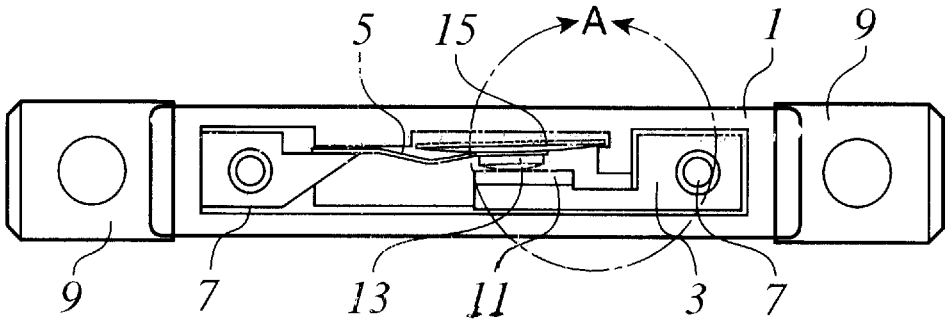
FIG. 3*a* is a side-elevational view of the switch of FIG. 1 along direction S with the switch lid removed, showing the switch in a closed position.
Figure 3B:
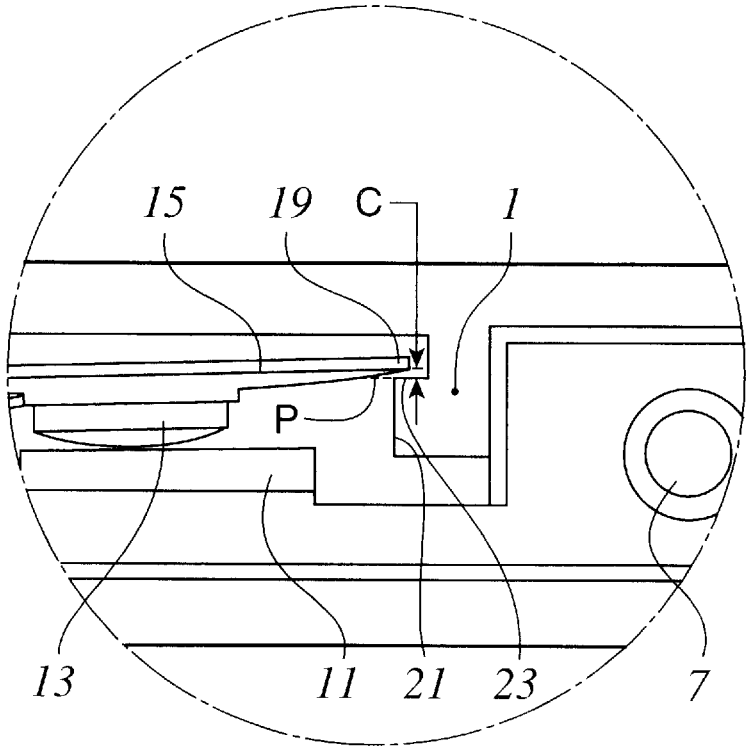
FIG. 3*b* is an enlarged view of portion A in FIG. 3*a*.
Figure 4A:
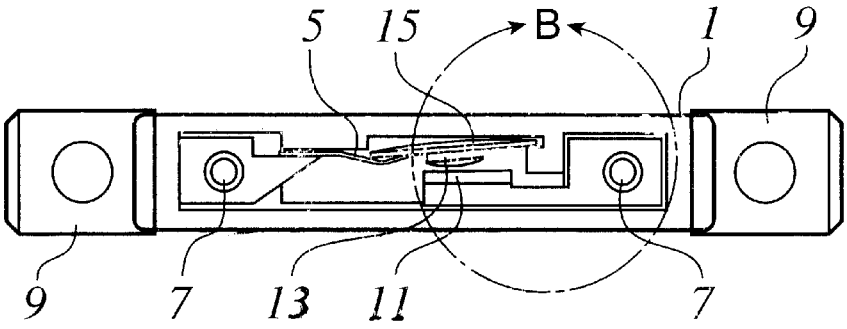
FIG. 4*a* is a view similar to FIG. 3*a*, showing the switch in an open position.

As can be appreciated in FIGS. 3*a* and 4*a* in particular, the bimetallic switch as shown provides an assembly of the individual components shown in an exploded view in FIGS. 1 and 2 such that a snapping direction of the bimetallic disc (that is, the direction in which contact 13 moves in relation to contact 11 in order to open or close the switch) is orthogonal to a direction of current flow between the terminals 9 and the arms 3 and 5. Advantageously, the bimetallic disc may be oriented in this manner such that a plane including therein the disc's outer edge 19 (FIG. 3*b*) is orthogonal relative to the plane of the terminals 9. This orientation advantageously enables the disc 15 to be disposed in a vertical plane in typical installations.

As seen in FIG. 3*a*, the switch as seen in a closed position involves the contacting engagement of contacts 11 and 13 with one another for establishing a current from one terminal 9 to the other as can be appreciated by one skilled in the art. As shown in FIG. 3*b*, the bimetallic disc, in its first mode, corresponds to a closed position of the switch (which, in this embodiment, is a rest mode of the switch), and has a concave shape, its outer edge 19 being directed away from contact 11 and its central dish-shaped portion flexing in a direction toward contact 11 to keep contact 13 in engagement with contact 11. As further seen in FIG. 3*b*, a step 21 is provided integrally formed with, or secured, to inner walls of housing 1, step 21 being dimensioned with respect to outer edge 19 of bimetallic disc 15 such that a clearance C is defined between edge 19 and an engaging surface 23 of step 21 when the bimetallic element is in its first mode, which, in the shown embodiment, corresponds to a closed position of the switch. It is to be noted that, while the shown embodiment involves a switch where the first mode of the bimetallic disc corresponds to a closed position of the switch (i.e., normally closed in its rest or ambient mode), the invention includes within its scope a switch where the bimetallic element is disposed in a mode that corresponds to an open position of the switch (normally open in its rest or ambient mode), as can be appreciated by a person skilled in the art. Regardless of whether the rest or ambient mode corresponds to an open position or closed position of the switch, however, the step is preferably disposed on the contact side of the bimetallic disc to effectively isolate creep during opening of the contacts.

Clearance C has a dimension with is pre-selected in conformity with a curvature of disc 15, and which is further a function of, primarily, the readily observable creeping characteristics of the disc being used between the selected threshold temperatures. What is meant by "step" in the context of the invention is any volume of material of any suitable shape which provides the desired clearance with respect to the outer edge of the bimetallic disc such that a creep thereof is isolated, as will be explained in detail further below. As shown, the "step" may be sized and shaped to extend in a plane which is substantially parallel to the plane of edge 19, and which intersects the disc at a point within a predetermined range of 65 to 95 percent of the disc radius when the surface of the disc closest to the step is in its convex position as shown in FIG. 3*b*. The above applies whether or not the switch is normally open or normally closed, that is, whether it is open or closed in its rest mode or ambient temperature. In FIG. 3*b*, this plane is depicted by broken lines indicated by the letter P. Referring now to FIG. 4*a*, the switch as seen in an open position shows contacts 11 and 13 as having been separated from one another for breaking the flow of current from one terminal 9 to the other. In an open position, the bimetallic disc has a convex shape, its outer edge 19 being directed toward contact 11 and its central dish-shaped portion flexing in a direction away from contact 11 to keep contact 13 separated from contact 11.

Figure 4B:
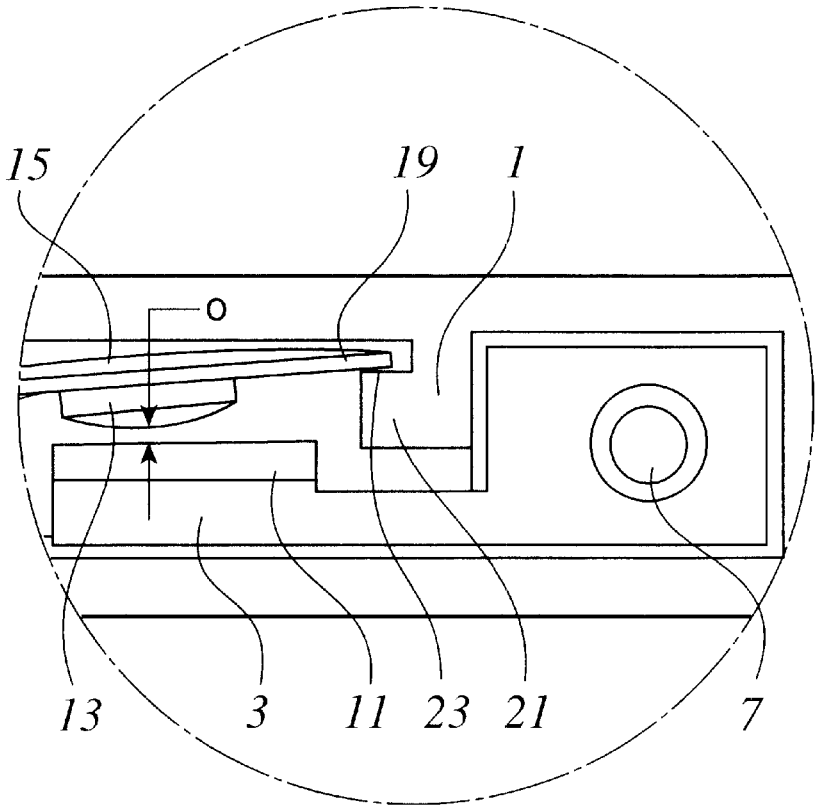
FIG. 4*b* is an enlarged view of portion B in FIG. 4*a*.

As seen further in FIG. 4*b*, in an open position of the bimetallic switch, the bimetallic disc has its outer edge 19 resting upon upper surface 23 of step 21, such that there is substantially no clearance therebetween.

It is to be noted that, while the above example depicted in the appended drawings relates to an automatic reset switch, the invention is meant to include within its ambit switch constructions which involve other types of bimetallic switches, such as manual resets and one shots as described above. In addition, in the instant disclosure, the words "bimetallic" and "bimetal" encompass constructions where the snap action element is made of two or more types of metal for being thermally responsive to effect the desired switch over. Thus, trimetallic switches, for example, are also included within the scope of the invention.

In operation, the switch in its rest or ambient temperature mode is in its closed position (the bimetallic disc being in its first or closed mode) as seen in FIGS. 3*a* and 3*b* between two threshold temperatures, a high temperature or "hot snap" temperature, and a low temperature or "cold snap" temperature. As an example, these two temperatures can be, for example, 145° Celsius and 90° Celsius, respectively. When the temperature rises to close to 145° Celsius, the deformation of the bimetallic disc progresses gradually until the amount of deformation has reached the threshold value. At that time, the deformation progresses quickly. The step at which the deformation progresses gradually during the initial stage is called creep. The process at which the deformation progresses rapidly is called snap action. During the creeping stage, in the shown embodiment, outer edge 19 of disc 15 begins to deform first, tending to move in the direction of contact 11. Without the provision of clearance C with respect to surface 23 of step 21, a gradual deformation of outer edge 19 could cause the electrical contacts to open slightly, potentially causing arcing, and thus significantly affecting the life of the contacts. However, clearance C allows the slow deformation to take place while still allowing the contacts to remain in engagement. Since the changes in the shape of the disc occur at edge 19 first, the clearance isolates the creep area and allows only the pure snap region of the disc to be used. After the threshold temperature of 145° Celsius has been reached, this pure snap region (that is, the region which does not creep but snaps at the threshold temperature) then snaps and breaks the current between contacts 11 and 13, thereby opening the switch (and placing the bimetallic disc in its open mode) as shown in FIGS. 4*a* and 4*b*. In this mode, disc 15 is dome shaped, and its outer edge 19 rests with substantially no clearance on surface 23 of step 21.

Conversely, for establishing a contact closure, the temperature must drop to below 90° Celsius. When the temperature is close to the cold snap temperature, outer edge 19 of disc 15 begins to slowly deform, that is, to exhibit creep. Any effects of such creep are removed by maintaining a minimum open contact gap O (see FIG. 4*b*) between contacts 11 and 13 in their open position so that any movement of the contacts towards one another due to creep is harmless, i.e., fails to move the contact close enough to generate any arcing. The dimension of gap O is, similar to that of clearance C, is pre-selected in conformity with a curvature of disc 15, and is further a function of, primarily, the readily observable creeping characteristics of the disc being used between the selected threshold temperatures and at the selected voltage and amperage rating of the contacts 11 and 13. Advantageously, clearance C has dimensions from about 0.015" to 0.020", (preferably about 0.020") and the contact gap O has dimensions from about 0.010" to 0.015" (preferably 0.015"). These ranges are effective for substantially all of the various discs within the stated preferred temperature range of 32 to 450 degrees Fahrenheit. It is to be noted that dimensional tolerances of the individual components of the shown switch may be as high as 0.004" or more. As can be appreciated from the above construction, and, especially, from the provision of clearance C, the construction of the switch according to the invention allows the use of bimetallic switches of a simple and cost effective construction where the effects of creep are neutralized, thereby providing a switch of simplified construction which has a longer contact life. Additionally, the provision of gap O adds to the above advantage by removing the effects of creep during contact closure, thus providing predictability of switch behavior in the vicinity of the cold snap temperature.

As can be readily appreciated from FIGS. 3*a*, 3*b*, 4*a* and 4*b*, in this preferred embodiment of the invention, disc 15 is oriented such that a snapping direction thereof is perpendicular to a direction of current flow between the terminals 9 on the one hand and the arms 3 and 5 on the other hand, that is, the direction of current flow into and out of either of the terminals 9 as applicable. Advantageously, the bimetallic disc may be oriented in this manner such that a plane including therein the disc's outer edge 19 is orthogonal relative to the plane of the terminals 9. This orientation advantageously enables the disc 15 to be disposed in a vertical plane in typical installations. The above allows for a smaller footprint for installation while preserving the ability to maintain large contact hold forces through the use of larger discs. A smaller horizontally placed disc may warrant the need for a moment arm system to open and close the contacts. The orientation of the disc according to this embodiment of the invention thereby advantageously provides a space-saving, simplified construction which is additionally effective for creating the desired large contact hold forces of the switch. It will be apparent to those skilled in the art that the disclosed invention may be modified in numerous ways and may assume many embodiments other than the preferred forms specifically set out and described above. Accordingly, it is intended by the appended claims to cover all modifications of the invention which fall within the true spirit and scope of the invention.

What is claimed is:

1. A bimetallic switch comprising:

a bimetallic element having an outer edge and being adapted to snap between a first mode and a second mode;

a first contact disposed on the bimetallic element, the first contact being supported by one end of a cantilever, movable arm;

a first terminal electrically conductively coupled to the first contact;

a second contact disposed adjacent the first contact such that, when the switch is in a closed position, the second contact and the first contact are in engagement with one another, and when the switch is in an open position, the second contact and the first contact define an open contact gap therebetween;

a second terminal electrically conductively coupled to the second contact; and a step disposed adjacent the outer edge of the bimetallic element such that a clearance is defined therebetween when the bimetallic element is in its first mode, the clearance being positioned and dimensioned such that, when the outer edge of the bimetallic element deforms prior to a snapping thereof out of its first mode, the clearance isolates a deformation of the outer edge until the snapping of the bimetallic element.

2. The bimetallic switch according to claim 1, wherein the bimetallic element is a bimetallic disc.

3. The bimetallic switch according to claim 2, wherein the step is dimensioned and shaped to extend in a plane that is substantially parallel to a plane including an outer edge of the bimetallic disc and which intersects the bimetallic disc at a point within a predetermined range of 65 to 95 percent of a radius thereof when the bimetallic disc is in its closed mode.

4. The bimetallic switch according to claim 1, further comprising a housing having inner walls defining an enclosure therein, wherein:

the bimetallic element, the first contact and the second contact are disposed within the enclosure; and the step is integral with the inner walls of the housing.

5. The bimetallic switch according to claim 4, wherein the housing is parallelepiped shaped, the bimetallic switch further including a cover for closing the enclosure.

6. The bimetallic switch according to claim 1, wherein the bimetallic element is oriented such that a snapping direction thereof is perpendicular to a direction of current flow into and out of at least one of the first terminal and the second terminal.

7. The bimetallic switch according to claim 6, wherein:

the first terminal and the second terminal are substantially planar; and the bimetallic element is a bimetallic disc being oriented such that a plane including its outer edge is orthogonal relative to a plane of the first terminal and the second terminal.

8. The bimetallic switch according to claim 1, wherein the step is configured such that, when the outer edge of the bimetallic element has deformed just prior to a snapping thereof, the outer edge rests upon an engaging surface of the step substantially without a clearance therebetween.

9. The bimetallic switch according to claim 1, wherein the first mode of the bimetallic element corresponds to a closed position of the switch, and the second mode of the bimetallic element corresponds to an open position of the switch.

10. The bimetallic switch of claim 9, wherein the clearance isolates the deformation of the outer edge until the snapping of the bimetallic element opens the contacts.

11. The bimetallic switch according to claim 9, wherein the first contact is positioned with respect to the second contact for maintaining a minimum open contact gap therebetween, thereby isolating creep during contact closure.

12. The bimetallic switch according to claim 1, wherein the first mode of the bimetallic element corresponds to an open position of the switch, and the second mode of the bimetallic element corresponds to a closed position of the switch.

13. The bimetallic switch of claim 12, wherein said first contact and said second contact are sized and shaped to carry current of up to at least 20 Amps at 120 Volts AC and a current of up to at least 10 Amps at 240 Volts AC.

14. The bimetallic switch of claim 1, wherein said clearance is within a range of about 0.015 to 0.020 inches.

15. The bimetallic switch of claim 14, wherein said clearance is about 0.02 inches.

16. The bimetallic switch of claim 1 further comprising a stationary arm disposed adjacent the cantilever arm and supporting the second contact thereon.

17. A bimetallic switch comprising:

a bimetallic disc having an outer edge and being adapted to snap between a first mode and a second mode;

a movable contact disposed on the bimetallic element;

a first terminal electrically conductively coupled to the movable contact;

a fixed contact disposed adjacent the movable contact such that, when the switch is in a closed position, the fixed contact and the movable contact are in engagement with one another, and when the switch is in an open position, the fixed contact and the movable contact define an open contact gap therebetween;

a second terminal electrically conductively coupled to the fixed contact;

a step disposed adjacent the outer edge of the bimetallic element such that a clearance is defined therebetween when the bimetallic element is in its first mode, the clearance being positioned and dimensioned such that, when the outer edge of the bimetallic element deforms prior to a snapping thereof out of its first mode, the clearance isolates a deformation of the outer edge until the snapping of the bimetallic element; and wherein the first terminal and the second terminal are substantially planar and the bimetallic disc is oriented such that a plane including its outer edge is substantially orthogonal relative to a plane of the first terminal and the second terminal.

18. The bimetallic switch of claim 17, wherein the bimetallic disc is oriented such that a snapping direction thereof is perpendicular to a direction of current flow into and out of at least one of the first terminal and the second terminal.

19. A bimetallic switch comprising:

a bimetallic disc having an outer edge and being adapted to snap between a first mode and a second mode;

a movable contact disposed on the bimetallic element;

a first terminal electrically conductively coupled to the movable contact;

a fixed contact disposed adjacent the movable contact such that, when the switch is in a closed position, the fixed contact and the movable contact are in engagement with one another, and when the switch is in an open position, the fixed contact and the movable contact define an open contact gap therebetween;

a second terminal electrically conductively coupled to the fixed contact;

a step disposed adjacent the outer edge of the bimetallic element such that a clearance is defined therebetween when the bimetallic element is in its first mode, the clearance being positioned and dimensioned such that, when the outer edge of the bimetallic element deforms prior to a snapping thereof out of its first mode, the clearance isolates a deformation of the outer edge until the snapping of the bimetallic element; and wherein the step is dimensioned and shaped to extend in a plane that is substantially parallel to a plane including an outer edge of the bimetallic disc.

20. The bimetallic switch of claim 19, wherein the step intersects the bimetallic disc at a point within a predetermined range of 65 to 95 percent of a radius thereof when the bimetallic disc is in its closed mode.

21. The bimetallic switch according to claim 19, further comprising:

a cantilever, movable arm supporting the bimetallic element at one end thereof; and a stationary arm disposed adjacent the cantilever arm and supporting the fixed contact thereon.

22. A method of fabricating a bimetallic switch, the method comprising:

providing a cantilever, movable arm supporting a bimetallic element at one end thereof, the bimetallic element having an outer edge and being adapted to snap between a first mode and a second mode;

disposing a first contact on the bimetallic element;

coupling a first terminal electrically conductively to the first contact;

disposing a second contact adjacent the first contact so that when the switch is in a closed position, the first contact and the second contact are in engagement with one another, and when the switch is in the open position the first contact and the second contact define an open contact gap therebetween;

coupling a second terminal electrically conductively to the second contact;

disposing a step adjacent the outer edge of the bimetallic element so that a clearance is defined therebetween when the contacts are in the closed position, the clearance being positioned and dimensioned so that, when the outer edge of the bimetallic element deforms prior to a snapping thereof out of its first mode, the clearance isolates a deformation of the outer edge until the snapping of the bimetallic element.

23. The method of claim 22, wherein the bimetallic element is a bimetallic disc.

24. A method of fabricating a bimetallic switch, the method comprising:

providing a bimetallic disc having an outer edge and being adapted to snap between a first position and a second position;

disposing the bimetallic disc on a movable contact;

coupling a first terminal electrically conductively to the movable contact;

disposing a fixed contact adjacent the movable contact so that, when the switch is in a closed position, the fixed contact and the movable contact are in engagement with one another, and when the switch is in an open position, the fixed contact and the movable contact define an open contact gap therebetween;

coupling a second terminal electrically conductively to the fixed contact;

disposing a step adjacent the outer edge of the bimetallic disc so that a clearance is defined therebetween when the contacts are in the closed position, the clearance being positioned and dimensioned so that, when the outer edge of the bimetallic disc deforms prior to a snapping thereof out of its first mode, the clearance isolates a deformation of the outer edge until the snapping of the bimetallic disc, the step being dimensioned and shaped to extend in a plane that is substantially parallel to a plane including an outer edge of the bimetallic disc.

* * * * *